US007583239B2

(12) United States Patent
Okubo et al.

(10) Patent No.: US 7,583,239 B2
(45) Date of Patent: Sep. 1, 2009

(54) WIRELESS COMMUNICATIONS DEVICE

(75) Inventors: Yoichi Okubo, Kodaira (JP); Kanemi Sasaki, Kodaira (JP); Hiroyuki Yasuda, Kodaira (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 634 days.

(21) Appl. No.: 11/366,430

(22) Filed: Mar. 3, 2006

(65) Prior Publication Data

US 2006/0202906 A1 Sep. 14, 2006

(30) Foreign Application Priority Data

Mar. 14, 2005 (JP) ..... 2005-070447
Sep. 12, 2005 (JP) ..... 2005-263226

(51) Int. Cl.
*H01Q 1/12* (2006.01)

(52) U.S. Cl. ..... 343/878; 343/872; 343/882

(58) Field of Classification Search ..... 343/872, 343/878, 882, 890, 891, 892
See application file for complete search history.

(56) References Cited

U.S. PATENT DOCUMENTS 6,342,870 B1 * 1/2002 Mehrkens et al. ..... 343/891
6,452,567 B1 * 9/2002 Overton ..... 343/891
6,512,492 B2 * 1/2003 Overton ..... 343/891
6,664,928 B2 * 12/2003 Ogawa et al. ..... 343/700 MS
7,106,273 B1 * 9/2006 Brunson et al. ..... 343/890

FOREIGN PATENT DOCUMENTS

JP 5-206942 8/1993
JP 5-300047 11/1993
JP 2001-45538 2/2001

* cited by examiner

*Primary Examiner*—Tan Ho
(74) *Attorney, Agent, or Firm*—Bacon & Thomas, PLLC

(57) ABSTRACT

A wireless system for use in a low power data communications in a sub-millimeter wave zone includes at least one wireless communications device including a directional antenna whose cross-polarization discrimination is not less than 24 dB, wherein the wireless system uses a plurality of planes of polarization selectively. The planes of polarization to be used are selected such that the number of non-occupied channels is largest by detecting the number of non-occupied channels depending on planes of polarization. The directional antenna, having a box shape whose front view is a right square, is formed as a single body with the wireless communications device, and the wireless communications device is fixed to a pole in a way that each side of the right square is slanted at 45° with respect to the pole.

3 Claims, 13 Drawing Sheets

WIRELESS COMMUNICATIONS DEVICE

FIELD OF THE INVENTION

The present invention relates to a wireless system; and, more particularly, to a wireless system for use in a low power data communications in a sub-millimeter wave zone whose effective channels are increased in number within a limited frequency range.

BACKGROUND OF THE INVENTION

Low power data communications systems capable of non-licensed wireless communications are already in practical use. Such systems do not need any license and are convenient to use. However, when such systems are being used, it is difficult to find out who are using them and how they are being used. Therefore, conventionally, such systems try to detect an interference, and if an interference is found, communications are performed through other channels or stopped until the interference disappears (see, for example, Japanese Laid-Open Applications No. 2001-45538, No. H5-300047 and No. H5-206942). Therefore, additional communications become practically impossible to be performed with such systems when the number of users thereof reaches a certain level.

This is inevitable in that, since any non-occupied channels can be used by anybody, users of the wireless systems for non-licensed communications, unlike ones for licensed communications, cannot secure specific communications channels for their exclusive use, causing inconveniences to the users thereof.

The conventional wireless systems for non-licensed communications has a drawback in that, even if a new user thereof has all the apparatuses for implementing such systems installed, there exists a possibility that non-occupied channels may not be available for the new user's use depending on the channel situation. Therefore, there have been demands for a method for increasing the number of effective channels within a limited frequency range.

SUMMARY OF THE INVENTION

It is, therefore, an object of the present invention to provide a wireless system whose effective channels are increased in number.

In accordance with the present invention, there is provided a wireless system for use in a low power data communications in a sub-millimeter wave zone, including at least one wireless communications device having a directional antenna whose cross-polarization discrimination is not less than 24 dB, wherein the wireless system uses a plurality of planes of polarization selectively.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

The present invention makes use of a feature of the electromagnetic wave that two electromagnetic waves whose planes of polarization are mutually orthogonal can be used without influencing each other. Thus, it is possible to increase the number of effective channels for a wireless system for a non-licensed communications in a sub-millimeter wave zone by using an antenna having an improved polarization characteristic.

Figure 1A:
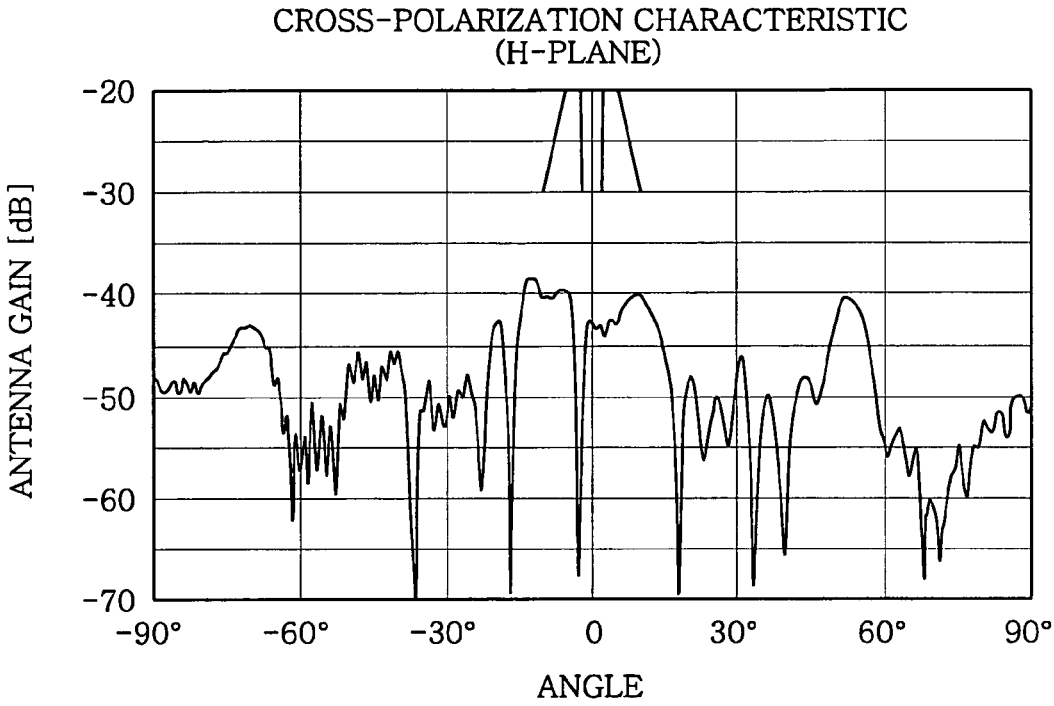
FIGS. 1A and 1B show graphs illustrating antenna gains of an exemplary antenna in a wireless system with respect to H plane and E plane, respectively.
Figure 1B:
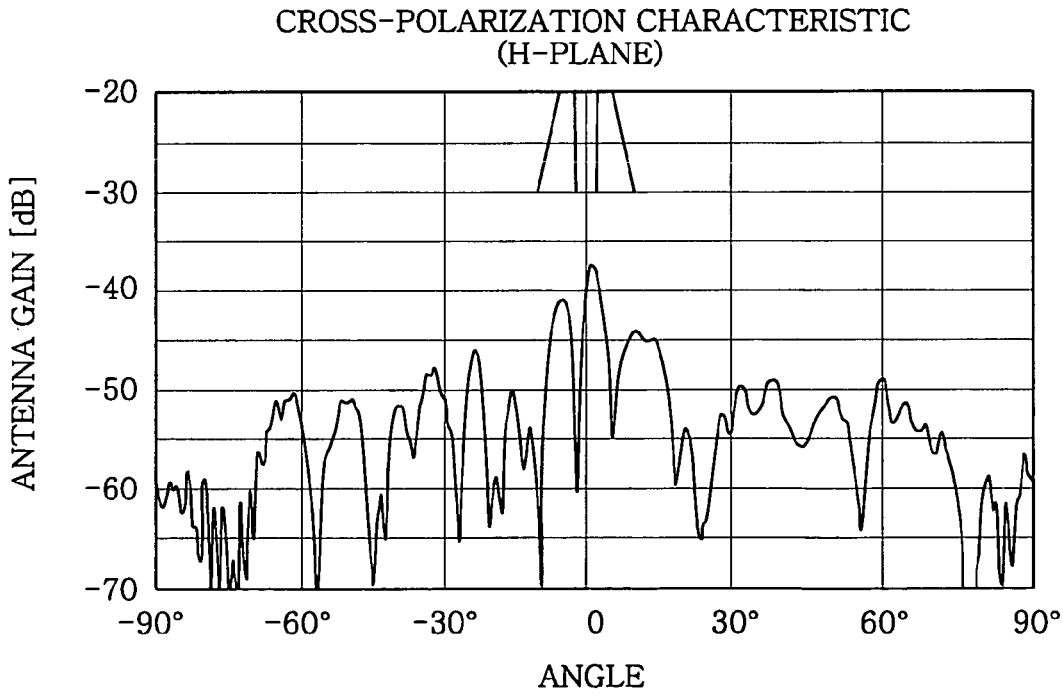

FIGS. 1A and 1B show graphs illustrating antenna gains of an exemplary antenna in a wireless system with respect to H plane and E plane, respectively. The antenna is a beam antenna of a sharp directivity, having an absolute gain of 31 dBi and a half power angle of 4 degrees. FIGS. 1A and 1B represent normalized antenna gains with respect to H plane and E plane, respectively, when an antenna is set to be orthogonal to a plane of polarization of the wireless system, wherein the normalized antenna gains are obtained by normalizing the antenna gains by a maximum of the antenna gain on the plane of polarization, i.e., the antenna gain at the center of the beam. The targeted value of the antenna gain, which is represented by line segments between −20 dB and −30 dB, can be achieved easily, since the antenna cross-polarization discrimination of 30 dB or more can be secured easily by using current technologies.

Figure 2:
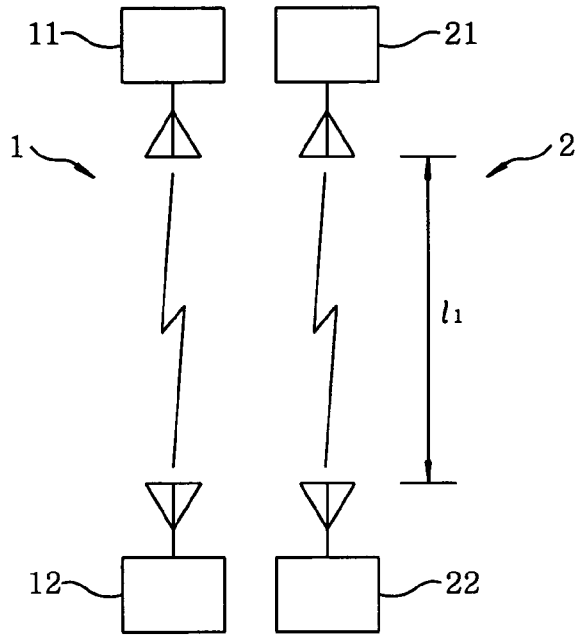
FIG. 2 illustrates an exemplary arrangement of a wireless system.

FIG. 2 illustrates an exemplary arrangement of a wireless system. The wireless system 1 includes wireless communications devices 11 and 12 respectively having an antenna and arranged in a direction opposite to each other to perform wireless communications therebetween. Additionally, another wireless system 2 including wireless communications devices 21 and 22 is arranged in parallel with the wireless system 1 in a manner that the wireless communications devices 12 is in line with the wireless communications devices 22, wherein the wireless system 2 uses a channel of a same frequency as that of the wireless system 1. In this case, since the wireless communications devices 11 and 21 are arranged to confront the wireless communications devices 12 and 22, respectively, a considerable degree of interference occurs therebetween. However, by setting the plane of polarization for the wireless system 2 to be different from that for the wireless system 1, interference can be reduced by the cross-polarization discrimination.

Let us assume that demodulations can be carried out with a carrier to noise ratio (C/N) of 16 dB in a 16 QAM (16-Quardrature Amplitude Modulation) scheme theoretically, and that the C/N reduction due to the interfering wave is 1 dB. Then, the C/N of the wireless system 1 would be 16 dB with an installation of the wireless system 2, but would be 17 dB if it were not for the wireless system 2. Therefore, the interference level with respect to the carrier can be obtained by the following:

$$0\text{-}10\log(10^{-1.6}\text{-}10^{-1.7})=24\text{ dB} \qquad \text{Eq. (1)}$$

Thus, if signals of the wireless system 1 propagate a substantially same distance as those of the wireless system 2 as shown in FIG. 2, and if the signal level of the wireless system 1 is substantially same as that of the wireless system 2, the interference level is lower than the cross-polarization discrimination by 6 dB.

Figure 3:
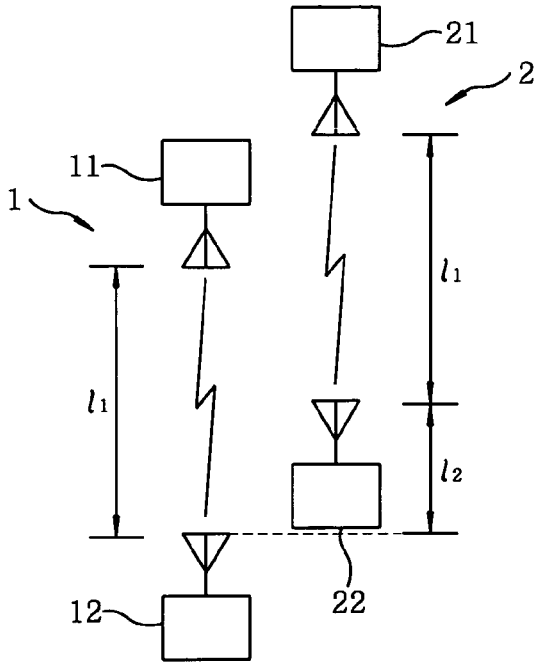
FIG. 3 provides another exemplary arrangement of the wireless system.

FIG. 3 provides another exemplary arrangement of the wireless system. As shown therein, the wireless communications device 11 and 21 are arranged to be opposite to the wireless communications devices 12 and 22 and distanced therefrom by $l_1$, respectively. Further, the wireless system 2 is arranged in parallel with the wireless system 1, and the wireless communications device 22 is positioned farther along the signal path by $l_2$ compared to the wireless communications device 21 such that a distance between the wireless communications device 21 and 22 is approximately $l_2$. With this arrangement, the interference is increased because the distance between the wireless communications devices 11 and 22 is reduced by approximately $l_2$. However, since the interference level is lower than the cross-polarization discrimination by 6 dB as can be seen by Eq. (1), the demodulation can be properly performed as long as the length $l_2$ does not exceed to a length equivalent to a propagation loss of 6 dB.

In general, a propagation loss in the sub-millimeter wave zone, e.g., 24.75 to 25.25 GHz or 27 to 27.5 GHz, in accordance with this embodiment amounts to a free space loss obtained by 20log d, wherein d is a propagation distance. Therefore, in this embodiment, the length equivalent to a propagation loss of 6 dB is $l_1/2$.

Figure 4:
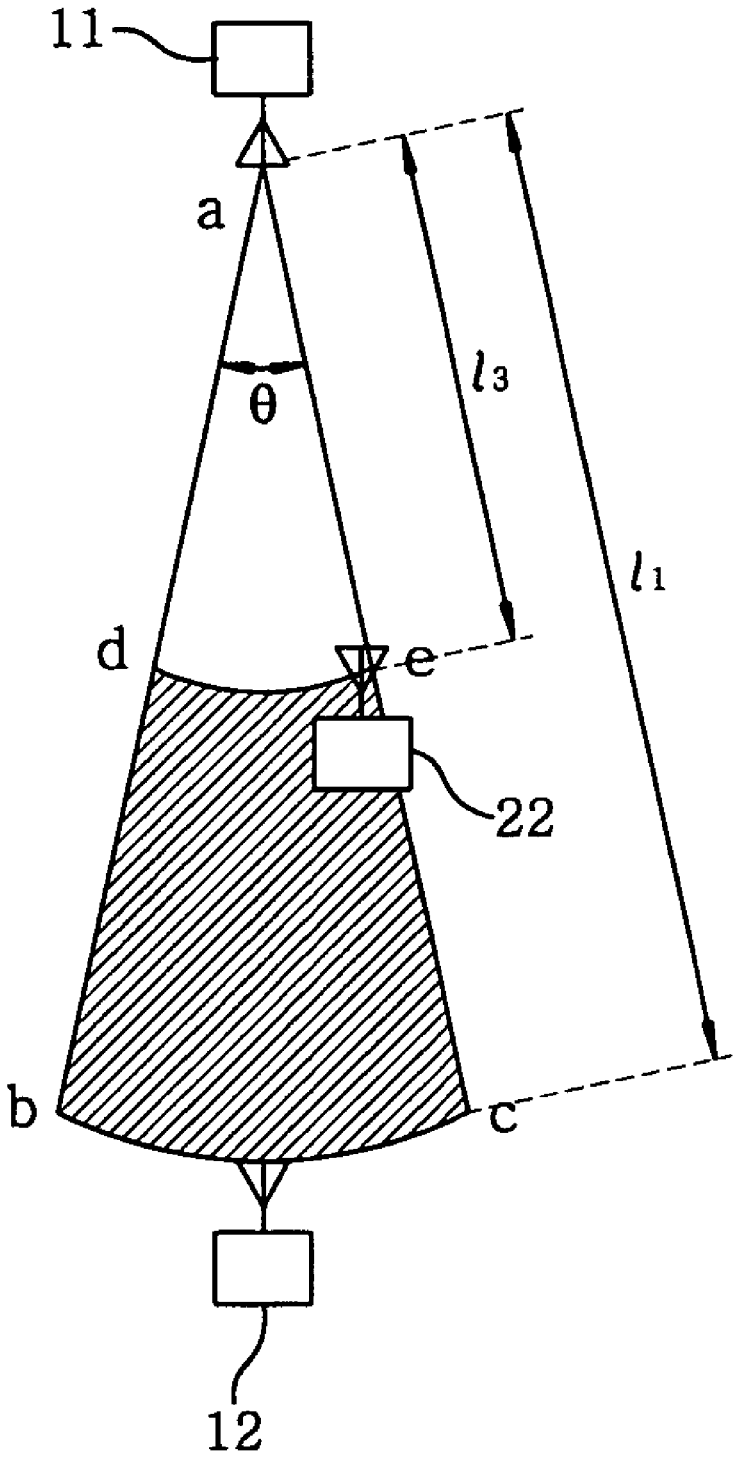
FIG. 4 represents a range where a wireless communications device can be installed in relation to another wireless communications device.

FIG. 4 represents a range where the wireless communications device 12 can be installed in relation to the wireless communications device 11. A fan shaped region abc represents a range where communications can be performed between the wireless communications devices 11 and 12, and. an angle θ is a half power angle.

If the wireless communications device 22 is installed in the region abc to be arranged opposite to the wireless communications device 11, the interference level is allowable in a region dbce where a distance to the wireless communications device 11 is longer than $l_3$, but is not allowable in a region ade where a distance to the wireless communications device 11 is shorter than $l_3$, wherein $l_3$ is equal to $l_1/2$.

Since an area of the region dbce is ¾ of that of the region ade, the ratio of reused frequency in the region abc is equal to 75%. This is equivalent to an increase in the number of effective channels by 7/4 times. Considering that, in principle, the number of effective channels cannot be increased more than two times by using two types of polarization, the 7/4 times increase in the number of effective channels can be assessed as a favorable result, and the cross-polarization discrimination of 30 dB can be roughly regarded as both necessary and sufficient. If the cross-polarization discrimination is set to be 20 dB, communications cannot be performed in a same frequency even when employing the arrangement of FIG. 2. Since the arrangement of FIG. 2 is expected to be used widely, the cross-polarization discrimination needs to be at least 24 dB.

In the description above, it was assumed that communications are performed with a maximum output power for a maximum communications distance. If a distance between the wireless communications devices 11 and 12 is shorter than the maximum communications distance, the output power of the wireless communications device 11 is attenuated to, at most, a minimum level necessary for communications, i.e., necessary for securing a C/N level of 17 dB. In this case, the interference level is allowable even when the distance between the wireless communications devices 11 and 22 is shortened to a half of the distance between the wireless communications devices 11 and 12, if the output power of the wireless communications device 12 is increased to secure the C/N level of the wireless communications device 11. In other words, even in a case where the wireless communications systems 1 and 2 are operated at a minimum and a maximum output power, respectively, the number of the effective channels is not less than 7/4 times that of the conventional case. Although $l_1$ shown in FIG. 4 is shortened, the interference level from the wireless communications device 11 to the wireless communications device 22 is not so high as to cause problems because the output power of the wireless communications device 11 is reduced.

In the following, a method for selecting a plane of polarization will be described. When installing a wireless communications device, firstly, the number of non-occupied channels is detected with regard to a horizontal polarization and a vertical polarization, respectively. Conversions between the horizontal polarization and the vertical polarization is performed by rotating the antenna by 90°.

The plane of polarization having a greater number of non-occupied channels can thus be found, and the antenna is installed thereon to use the wireless communications device. This is because the communications environment is more preferable when the number of non-occupied channels is greater.

First Embodiment

Figure 5:
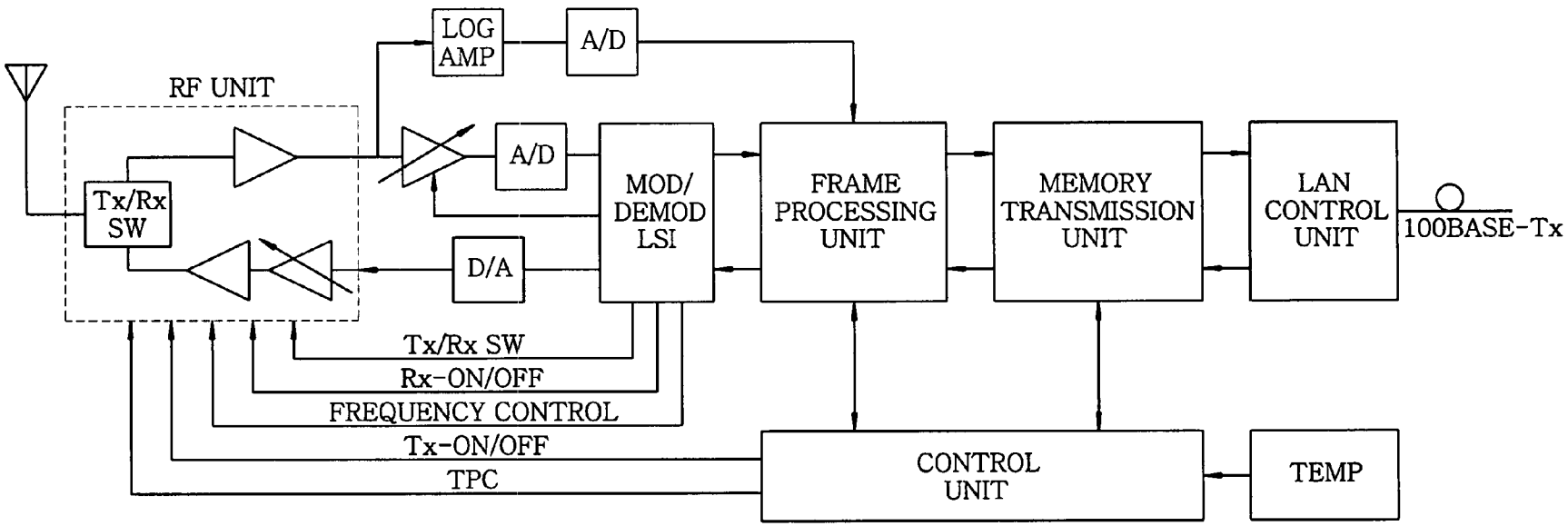
FIG. 5 offers a configuration diagram of a wireless communications device in a low power data communications system in accordance with a first embodiment of the present invention.

FIG. 5 offers a configuration diagram of a wireless communications device in a low power data communications system in accordance with a first embodiment of the present invention. The wireless communications device is connected to LAN by one-to-one wireless communications with another wireless communications device arranged opposite thereto by using TDD in a range of 25 GHz. A maximum communications distance thereof is about 1 km, and a maximum communications rate thereof is about 150 Mbps. The wireless communications device includes an antenna, an RF unit, a modulation/demodulation LSI, a frame processing unit, a memory transmission unit, a LAN control unit, and a controller unit. In the configuration shown in FIG. 5, the antenna is included therein and incorporated thereto. Further, the RF unit includes a mixer, a local oscillator, and a band pass filter (all not shown) to perform a frequency conversion. Furthermore, it may be configured such that information on, e.g., non-occupied channels can be obtained by, e.g., a proper command by a remote login to an IP address of the wireless communications device through telnet.

Figure 6A:
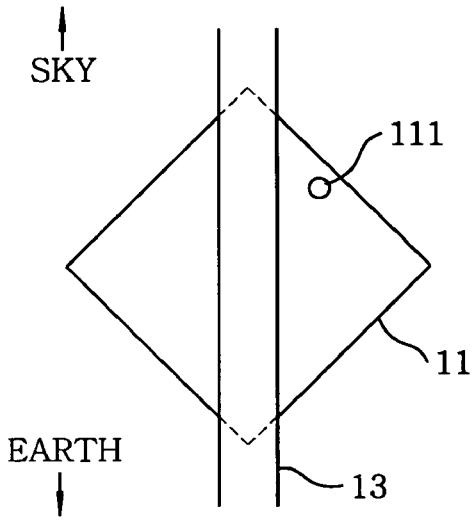
FIGS. 6A and 6B are rear views of exemplary arrangements of the wireless communications device in accordance with the first embodiment of the present invention.
Figure 6B:
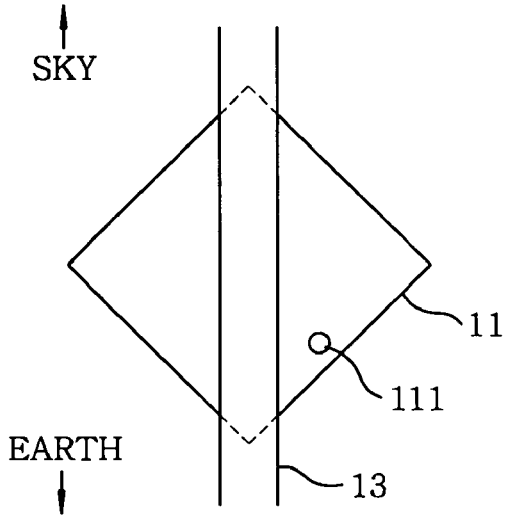

FIGS. 6A and 6B are rear views of exemplary arrangements of the wireless communications device 11 in accordance with the first embodiment of the present invention, wherein a plane of polarization of the antenna shown in FIG. 6A differs from that shown in FIG. 6B by 90°.

As shown in FIGS. 6A and 6B, the wireless communications device 11 is of a box shape and looks like a square when seen from a front thereof. An antenna and/or the like are accommodated therein at a front thereof, and a wireless circuit and/or the like are installed therein at a back side thereof. Used as the antenna is a planar antenna, e.g., a waveguide slot array, of a square shape.

A receiving terminal 111 is a contact plug through which an electric power is supplied and electric signals are inputted or outputted. A LAN cable (100 BASE-Tx), for example, is employed therein as a signal line, and a power supply can be also provided therefor by using a product of, e.g., Power Over Ethernet (registered trademark). The receiving terminal 111 is, for example, a "capcon", which is a waterproof cable clamp.

A pole 13 is usually installed in a vertical or horizontal direct with respect to a ground plane, i.e., a horizontal plane. Further, the wireless communications device 11 is fixed to the pole 13 by means of a fixing metallic part 16 (shown in FIG. 8) in a manner that four sides of the wireless communications device 11 are inclined at 45° with respect to the pole 13 when viewed from a front.

As shown in FIGS. 6A and 6B, when changing a plane of polarization, the wireless communications device 11 is installed to be rotated by 90°. Therefore, the introduction terminal 111 is arranged at a central portion of a side edge on the rear surface of the wireless communications device 11 in order for the pole 13 not to block or obstruct the introduction terminal 111 and/or a cable extended therefrom even when changing the plane of polarization.

Figure 7A:
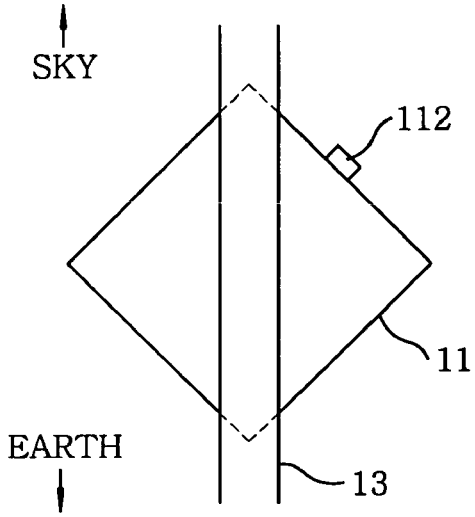
FIGS. 7A and 7B present rear views of other exemplary arrangements of the wireless communications device in accordance with the first embodiment of the present invention.
Figure 7B:
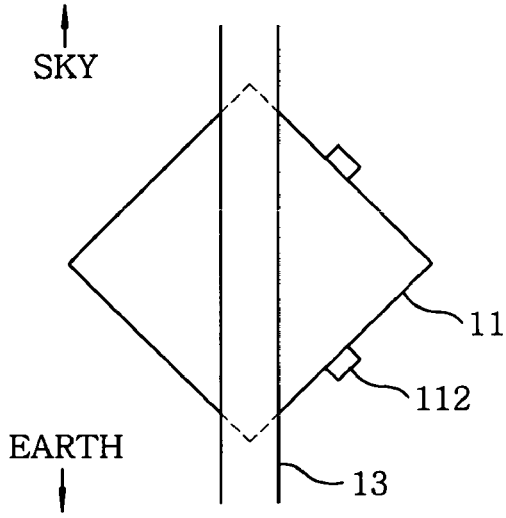

FIGS. 7A and 7B present rear views of other exemplary arrangements of the wireless communications device 11 in accordance with the first embodiment of the present invention. As shown therein, in accordance with these exemplary arrangements, an introduction terminal 112 is arranged at a central portion of a side surface of the wireless communications device 11. Also in this case, the pole 13 can be made not to block or obstruct the introduction terminal 111 and/or a cable extended therefrom.

Figure 8:
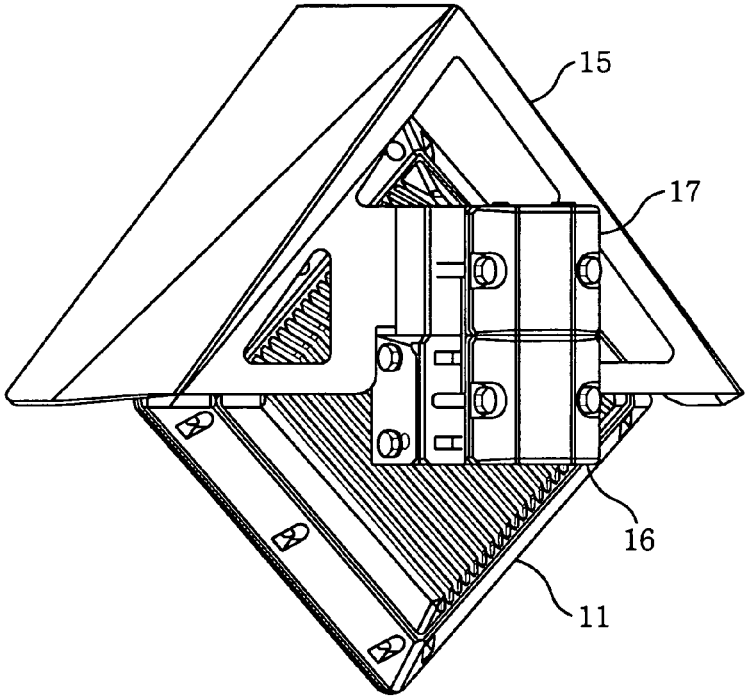
FIG. 8 provides a rear perspective view of a wireless communications device and compartments fixed thereto in a wireless system in accordance with the first embodiment of the present invention.
Figure 9:
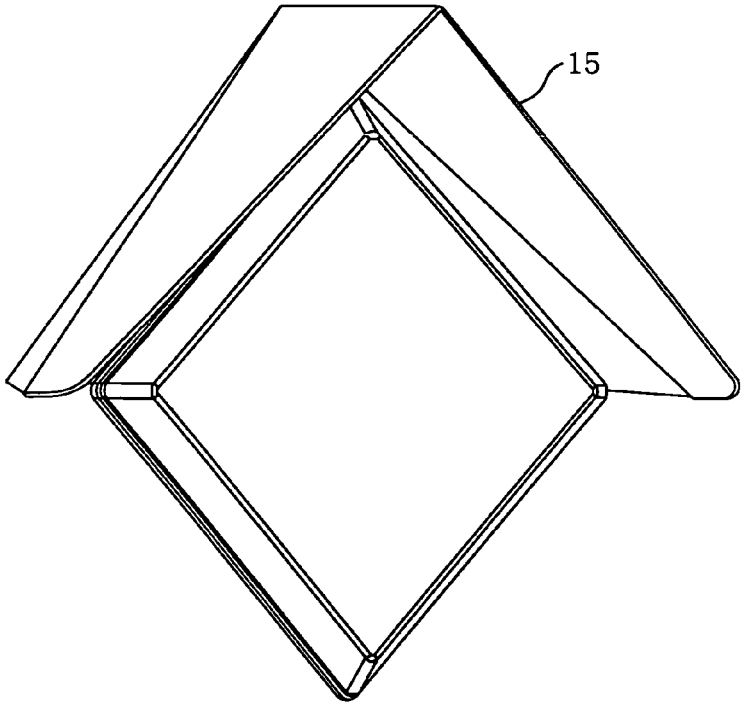
FIG. 9 illustrates a front perspective view of a wireless communications device and compartments fixed thereto in a wireless system in accordance with the first embodiment of the present invention.
Figure 10:
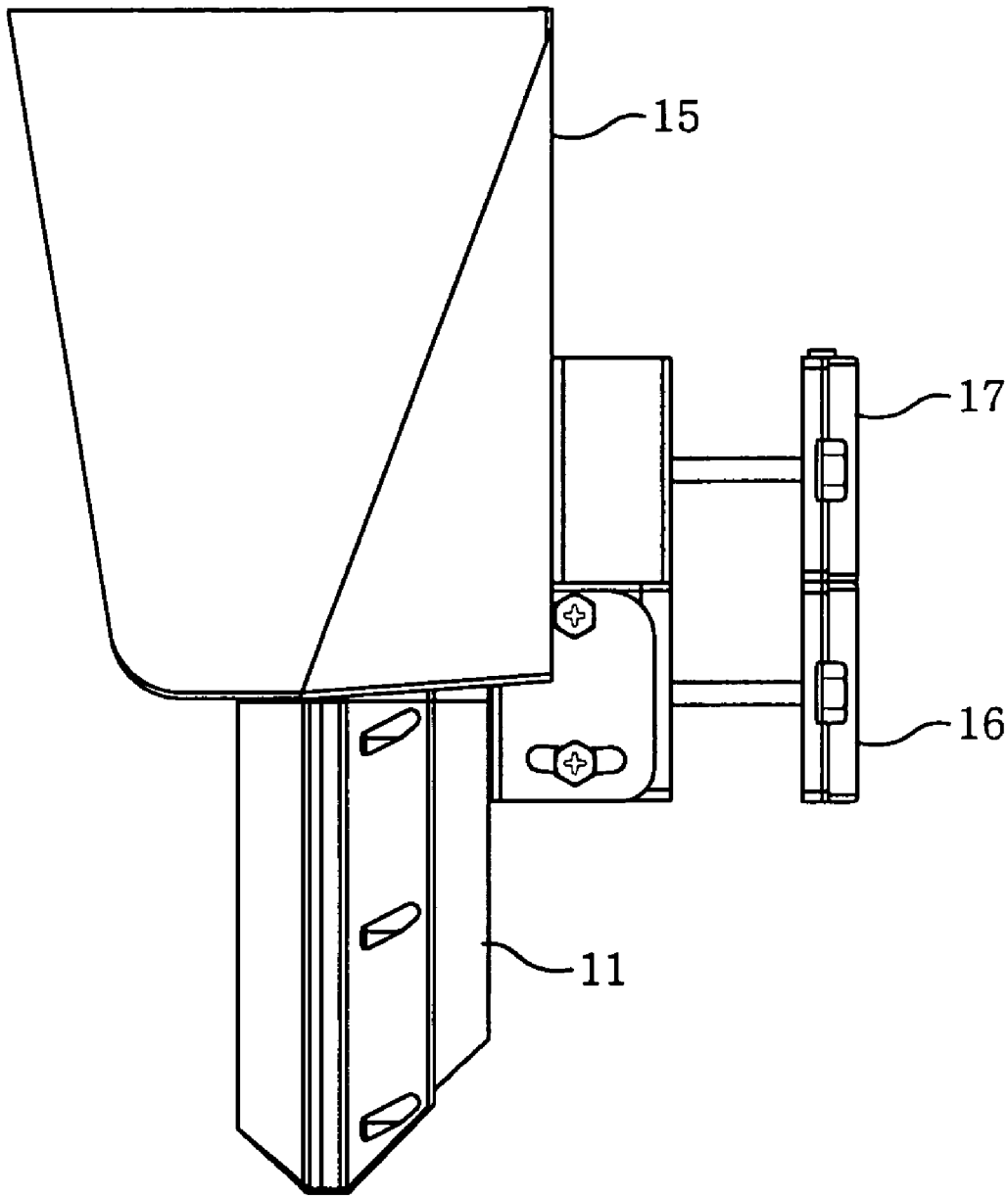
FIG. 10 shows a left side view of a wireless communications device and compartments fixed thereto in a wireless system in accordance with the first embodiment of the present invention.
Figure 11A:
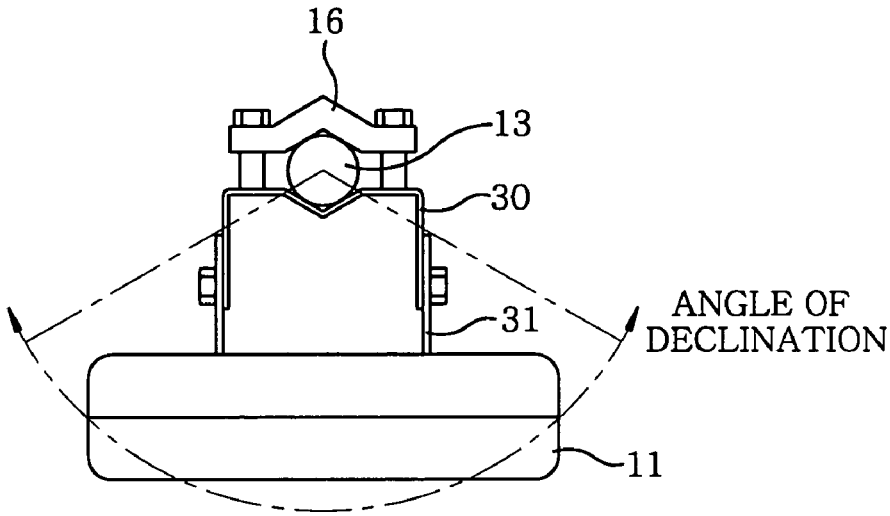
FIGS. 11A to 11D respectively describe a plane view, a front view, a side view and a rear view of the wireless communications device and compartments attached thereto in a wireless system in accordance with the first embodiment of the present invention, wherein a hood and a fixing metallic part are removed from the wireless communications device, and a pole is fixed to the wireless communications device.
Figure 11B:
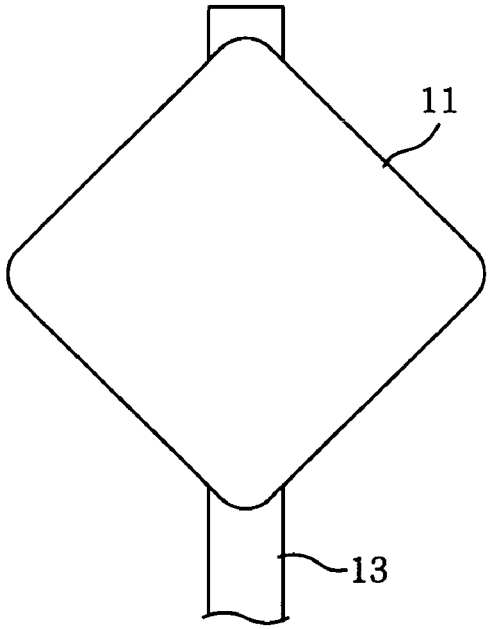
Figure 11C:
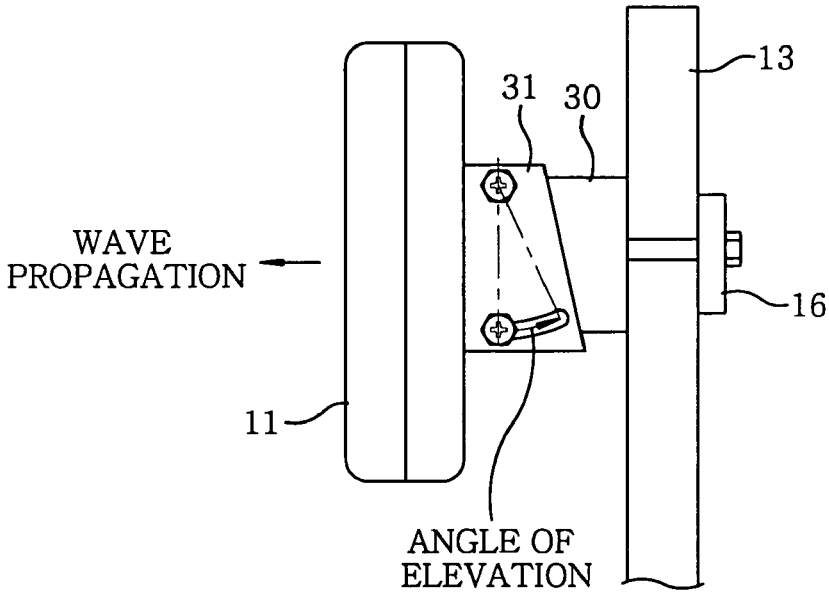
Figure 11D:
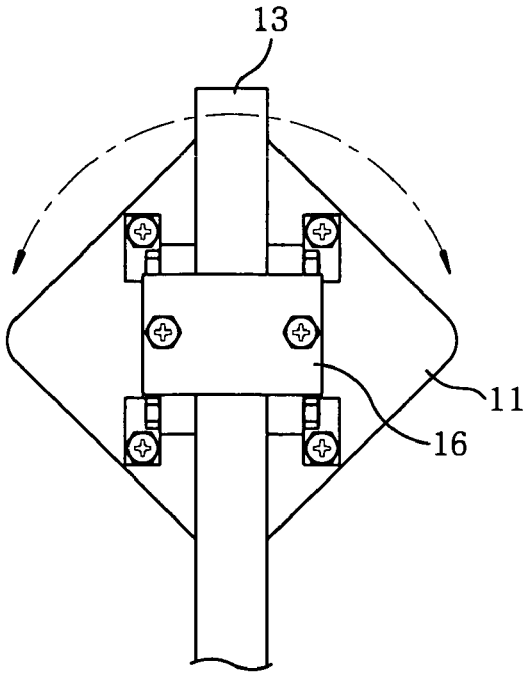

FIGS. 8 to 10 respectively provide a rear perspective view, a front perspective view and a left side view of the wireless communications device 11 and compartments fixed thereto in a wireless system in accordance with the first embodiment of the present invention.

As shown in FIGS. 8 and 9, a hood 15 is optionally installed to cover an upper portion of the wireless communications device 11. The hood 15 protects the wireless communications device 11 from snow, which causes an attenuation of communications signals by attaching to a front surface thereof, and also from rain, wind, falling objects, solar heat and so forth, thereby enhancing the reliability. The hood 15 is made of, e.g., an easy-to-fabricate metal plate, and has a shape of a triangular roof slanted at 45°. On the hood 15 or the front surface of the wireless communications device 11, an anti-adhesion agent for preventing snow or ice attached thereto may be coated.

As shown in FIG. 10, the fixing metallic part 16 for fixing the wireless communications device 11 to the pole 13 includes a clamping part for clamping the wireless communications device 11 to the pole 13; and a tilting part for adjusting a vertical tilt of an antenna beam of the wireless communications device 11. Further, it is possible to fix the wireless communications device 11 to the pole 13 at two different fixing angles which differ from each other by 90° by, for example, arranging screw grooves of the wireless communications device 11 and the fixing metallic part 16 in a manner symmetrical with respect to 90° rotation.

There is provided another fixing metallic part 17 for fixing the hood 15 to the pole 13. Since, as described above, the hood 15 is not provided as a part of the pole 13 but as a compartment independent from the pole 13 fixed thereto, the wireless communications device 11 and the antenna beam thereof can be protected from getting deformed or misaligned by external forces imposed on the hood 15, e.g., wind pressure.

Second Embodiment

FIGS. 11A to 11D respectively describe a plane view, a front view, a side view and a rear view of the wireless communications device 11 and compartments attached thereto in a wireless system in accordance with the first embodiment of the present invention, wherein the hood 15 and the fixing metallic part 17 are removed from the wireless communications device 11, and the pole 13 is fixed to the wireless communications device 11. The wireless communications device 11 shown in FIGS. 11A to 11D has a same configuration as that shown in FIG. 5. Further, the introduction terminals 111 and 112 are not shown therein. When installing the wireless communications device 11 in accordance with the second embodiment, it is investigated whether a plane of horizontal polarization or a plane of vertical polarization has more non-occupied channels, and the antenna included in the wireless communications device 11 to form a single body with wireless communications device 11 is installed in a manner to use a plane of polarization having more non-occupied channels.

In some cases, it becomes necessary to change a plane of polarization to be used, for example, when communications fail frequently by interferences due to an increase in the number of other communications systems using the same plane of polarization. However, a lot of effort and man hours are required therefor, since antenna fixing parts 30 and 31 shown in FIG. 11 have to be changed to change the plane of polarization to be used.

Figure 12A:
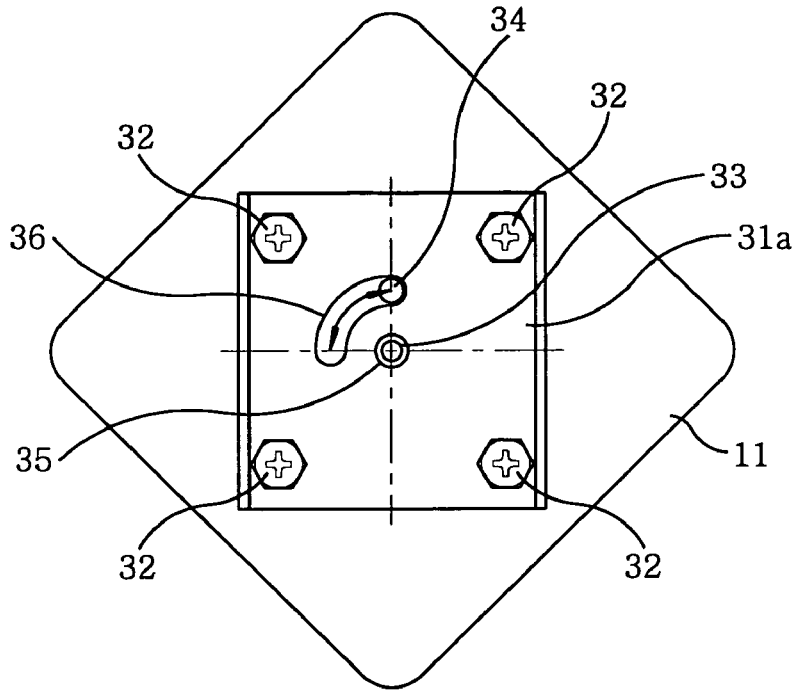
FIG. 12A offers a simplified rear view of the wireless communications device and compartments attached thereto in accordance with a first modification of a second embodiment of the present invention.
Figure 12B:
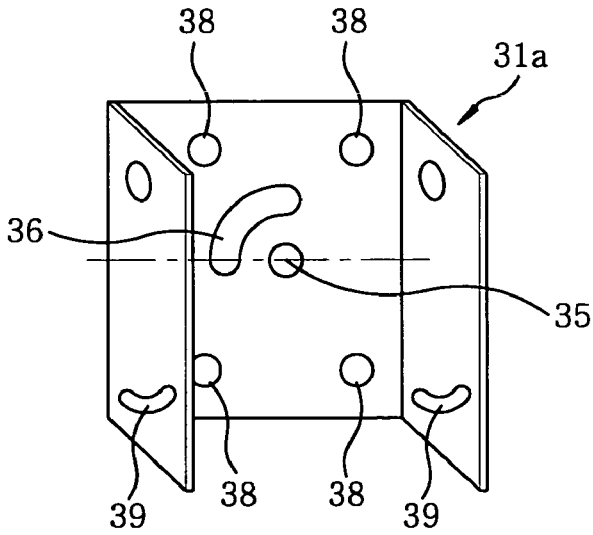
FIG. 12B shows a rear perspective view of an antenna fixing part separated from the wireless communications device in accordance with the first modification of the second embodiment of the present invention.
Figure 12C:
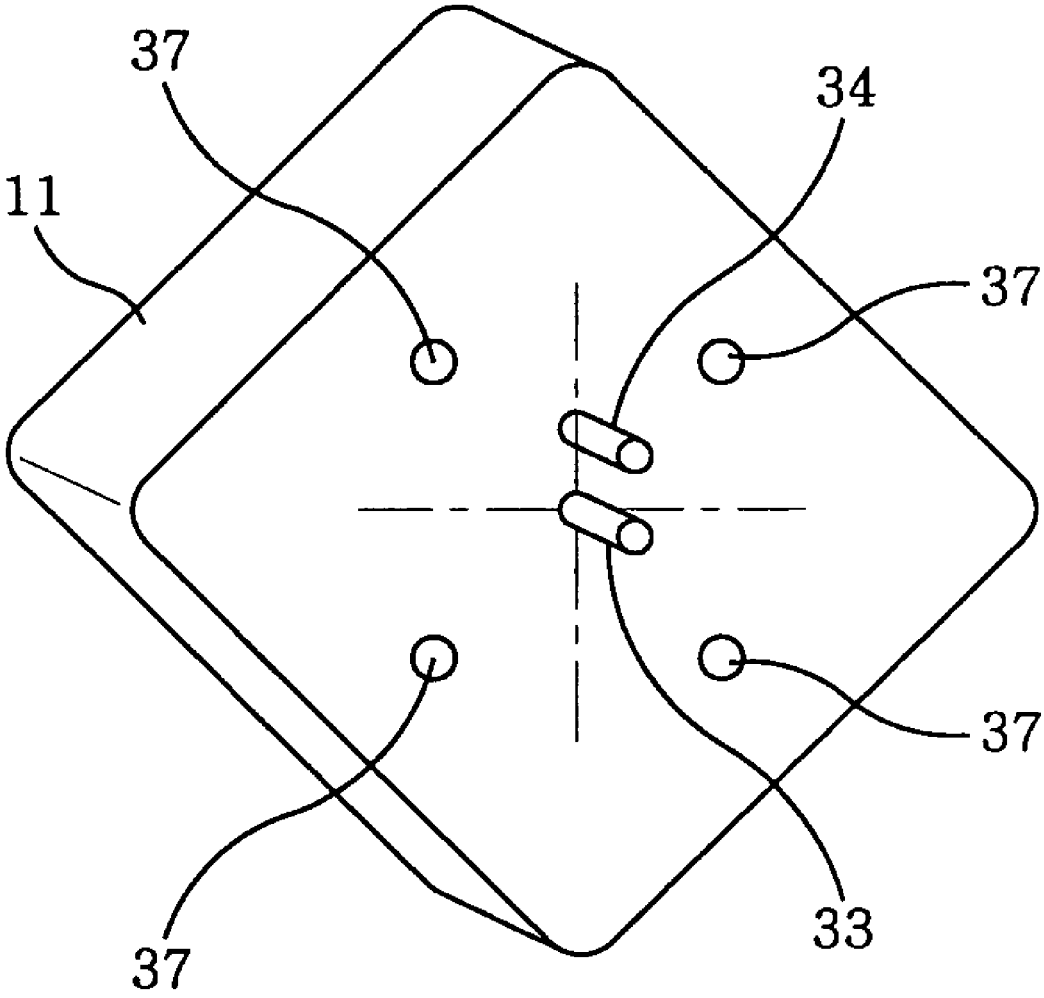
FIG. 12C depicts a simplified rear perspective view of the wireless communications device in a state where the antenna fixing part is removed therefrom in accordance with the first modification of the second embodiment of the present invention.

Therefore, there is proposed a second embodiment of the present invention, which is configured such that a plane of polarization to be used can be easily changed. FIG. 12A offers a simplified rear view of the wireless communications device 11 and compartments attached thereto in accordance with a first modification of the second embodiment of the present invention; FIG. 12B shows a rear perspective view of an antenna fixing part 31*a* separated from the wireless communications device 11 in accordance with the first modification of the second embodiment of the present invention; and FIG. 12C depicts a simplified rear perspective view of the wireless communications device 11 in a state where the antenna fixing part 31*a* is removed therefrom in accordance with the first modification of the second embodiment of the present invention. A plane view, a front view and a side view of the wireless communications device 11 and compartments attached thereto in accordance of a first modification of the second embodiment are same as those of the first embodiment, except that the antenna fixing part 31 is replaced by the antenna fixing part 31*a*. As shown therein, on a rear surface of the wireless communications device 11 are formed two bosses, i.e., cylindrical protrusions, 33 and 34 and four screw grooves 37 for fixing therein four bolts 32. Further, the antenna fixing part 31*a* has a hole 35 for inserting the boss 33; an arc hole 36 for inserting the boss 34; a hole 35 for inserting the boss 33; and four holes 38 for inserting the bolts 32.

The screw grooves 37 are respectively formed at four corners of a right square at whose center is located the boss 33. When the wireless communications device 11 is fixed to the pole 13 via the antenna fixing parts 30 and 31*a*, the wireless communications device 11 is arranged such that each side of the antenna is slanted at 45° with respect to a horizontal plane. The four holes 38 of the antenna fixing part 31*a* are arranged to coincide with the four screw grooves 37, being positioned at the four corners of the right square at whose center is located the boss 33. The arc hole 36 is designed such that it has a proper shape to allow the wireless communications device 11 to be rotated at 90° about the boss 33 as a rotational axis while the boss 33 is inserted in the hole 35, and the plane of polarization of the antenna is to coincide with the horizontal plane or the vertical plane depending the 90° rotation of the wireless communications device 11.

With the configurations in accordance with the first modification of the second embodiment, the plane of polarization can be changed by 90° by performing the steps of removing the four bolts 32 from the wireless communications device 11, rotating the wireless communications device 11 by 90° about the boss 33 as the rotational axis, and reinserting the four bolts 32 into the wireless communications device 11 to be fixed thereto. In this way, the plane of polarization can be changed more efficiently compared to the case where the antenna fixing parts 30 and 31 have to be replaced to change the plane of polarization.

Figure 13A:
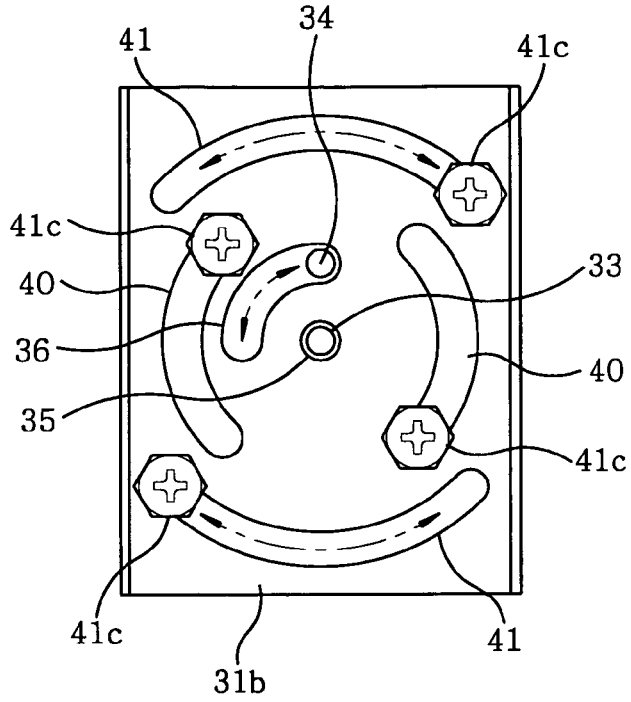
FIG. 13A offers a partial rear view of the wireless communications device and compartments attached thereto in accordance with a second modification of the second embodiment of the present invention.
Figure 13B:
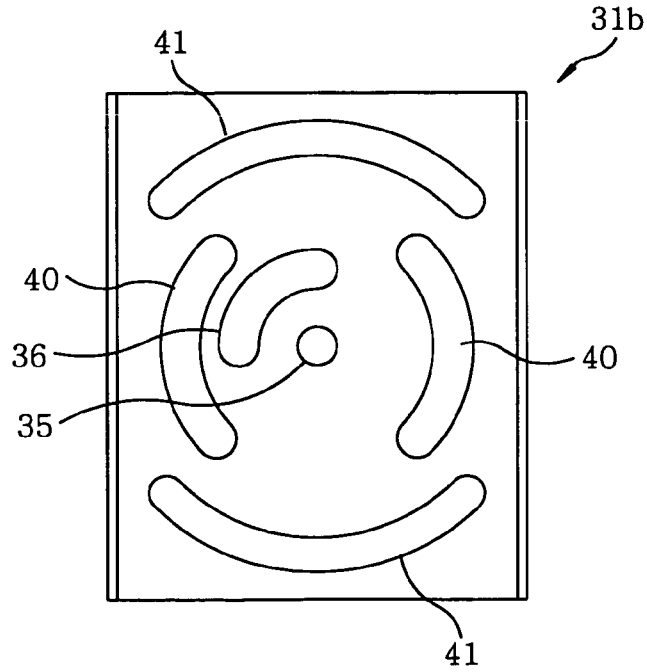
FIG. 13B shows a partial rear view of an antenna fixing part separated from the wireless communications device in accordance with the second modification of the second embodiment of the present invention.
Figure 13C:
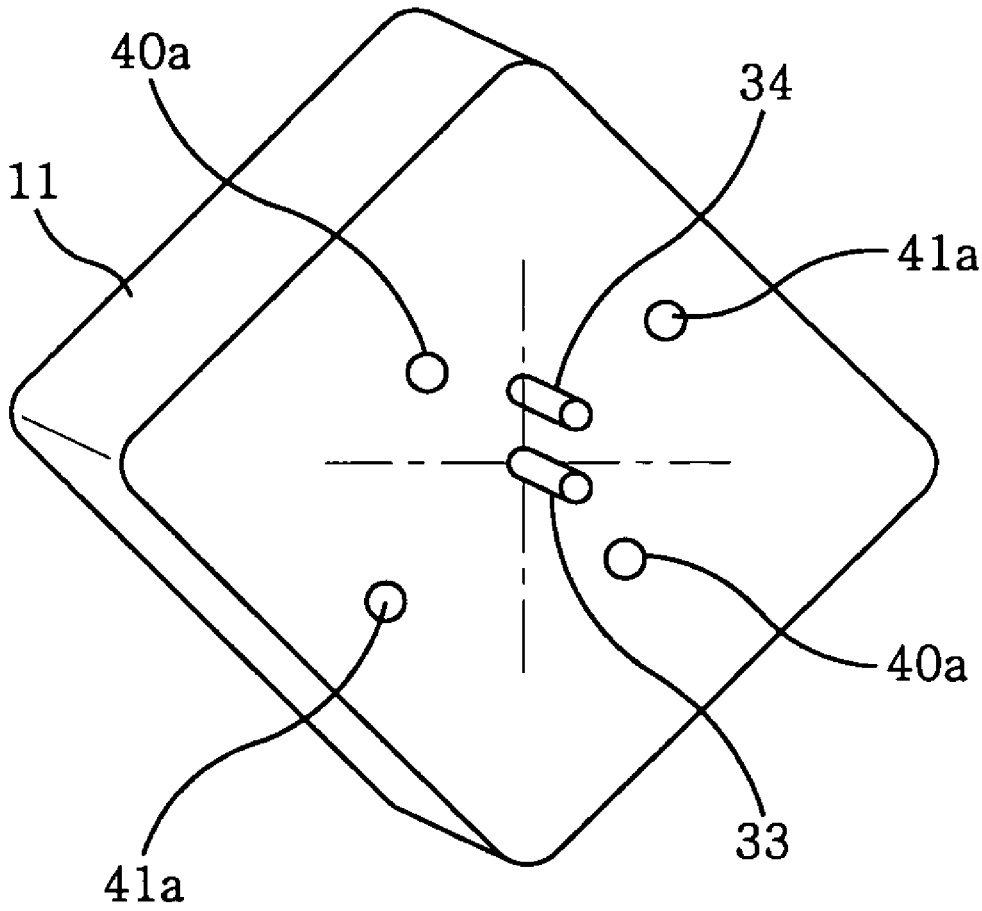
FIG. 13C depicts a simplified rear perspective view of the wireless communications device in a state where an antenna fixing part is removed therefrom in accordance with the second modification of the second embodiment of the present invention.

FIG. 13A offers a partial rear view of the wireless communications device 11 and compartments attached thereto in accordance with a second modification of the second embodiment of the present invention; FIG. 13B shows a partial rear view of an antenna fixing part 31*b* separated from the wireless communications device 11 in accordance with the second modification of the second embodiment of the present invention; and FIG. 13C depicts a simplified rear perspective view of the wireless communications device 11 in a state where the antenna fixing part 31*b* is removed therefrom in accordance with the second modification of the second embodiment of the present invention.

In accordance with the second modification of the second embodiment, the antenna fixing part 31*a* in the first modification of the second embodiment is replaced with the antenna fixing part 31*b*, and the bosses 33 and 34, the hole 35 and the arc hole 36 are formed on the wireless communications device 11 or the antenna fixing part 31*b* in a same manner as those shown in FIGS. 12A to 12C. However, two pairs of screw grooves 40*a* and 41*a* are arranged such that a distance between each of the screw grooves 40*a* and the boss 33 is different from that between each of the screw grooves 41*a* and the boss 33. Further, on the antenna fixing part 31*b* are formed a pair of arc holes 40 in a way symmetrical to each other with respect to the hole 35, and another pair of arc holes 41 in a way symmetrical to each other with respect to the hole 35 and perpendicular to the arc holes 40. In addition, a pair of bolts 40*c* are inserted and fixed into the screw grooves 40*a* through the arc holes 40, and a pair of bolts 41*c* are inserted and fixed into the screw grooves 41*a* through the arc holes 41, so that the wireless communications device 11 is fixed to the antenna fixing part 31*b*.

In accordance with this configuration, the arc holes 40 and 41 are formed such that, in a manner similar to the arc hole 36, the bolts 40*c* and 41*c* are to be positioned at one end of the arc holes 40 and 41 respectively, when the antenna is rotated by 90° about the boss 33. Thus, the plane of polarization can be changed by 90° by performing the steps of releasing the two pairs of the bolts 40*c* and 41*c*, rotating the antenna about the boss 33, and reinserting to fix the two pairs of the bolts 40*c* and 41*c* to the wireless communications device 11. In this way, the plane of polarization can be changed more efficiently.

Although the wireless communications device 11 was described to have a front view of a right square in the above description, the shape thereof should not be construed to be limited thereto, and may have shapes such as a circle, a rhombus, or a rectangle as its front view. Further, the antenna may not be a part of the wireless communications device 11 but a compartment independent therefrom. In addition, the plane of polarization need not be limited to the horizontal and vertical plane, and may be slanted with respect to the horizontal plane at a specific angle optimal for a specific transmission line.

The wireless system in accordance with the present invention, the number of effective channels can be increased by using an antenna having favorable cross-polarization characteristics.

While the invention has been shown and described with respect to the preferred embodiments, it will be understood by those skilled in the art that various changes and modification may be made without departing from the scope of the invention as defined in the following claims.

What is claimed is:

1. A wireless communications device for use in a low-power wireless data communications system using a sub-millimeter wave band, wherein the system selectively uses a plurality of planes of polarization to have an increased number of effective channels, the device comprising:

a directional antenna set on the planes of polarization having the highest number of non-occupied channels by detecting the number of non-occupied channels on each plane of polarization the directional antenna having a cross-polarization discrimination that is not less than 24 dB; and a first boss and a second boss protruded from a rear surface of the wireless communications device, wherein an antenna fixing part having a first hole and a second hole formed therein is fixed to the rear surface of the wireless communications device in a manner that the first and the second boss are inserted into the first and the second hole, respectively, the second hole being formed in such a shape as to allow the wireless communications device to be rotated at 90° about the first boss as a rotational axis while the first and the second boss are inserted in the first and the second hole.

2. The wireless communications device of claim 1, further comprising:

a plurality of fixing grooves formed on the rear surface thereof in a manner to be arranged at four corners of a right square, wherein the antenna fixing part further has a plurality of fixing holes formed therein at positions corresponding to the fixing grooves, and wherein the wireless communications device is fixed to the antenna fixing part by inserting a plurality of fixing elements into the fixing grooves through the fixing holes.

3. The wireless communications device of claim 1, further comprising:

two pairs of first fixing grooves on the rear surface thereof in a manner that a distance between the first boss and one of the first fixing grooves is same as that between the first boss and any other of the first fixing grooves; and two pairs of second fixing grooves formed on the rear surface thereof in a manner that a distance between the first boss and one of the second fixing grooves is same as that between the first boss and any other of the second fixing grooves, where in the antenna fixing part further has a pair of first fixing holes formed therein at positions corresponding to one pair of the first fixing grooves and a pair of second fixing holes formed therein at positions corresponding to one pair of the second fixing grooves;

wherein the wireless communications device is fixed to the antenna fixing part by inserting a pair of first fixing elements into said one pair of the first fixing grooves through the first fixing holes, respectively, and by inserting a pair of second fixing elements into said one pair of the second fixing grooves through the second fixing holes, respectively; and wherein the first and second fixing holes are formed in such shapes as to allow the wireless communications device to be rotated at 90° about the first boss as the rotational axis while the first and the second fixing elements are inserted in the first and the second fixing holes.

* * * * *

UNITED STATES PATENT AND TRADEMARK OFFICE

CERTIFICATE OF CORRECTION

PATENT NO. : 7,583,239 B2
APPLICATION NO. : 11/366430
DATED : September 1, 2009
INVENTOR(S) : Okubo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this

Fourteenth Day of September, 2010

David J. Kappos

David J. Kappos
*Director of the United States Patent and Trademark Office*